US005521688A

United States Patent [19]

Moser

[11] Patent Number: 5,521,688

[45] Date of Patent: May 28, 1996

[54] HYBRID COLOR FUSER

[75] Inventor: Rabin Moser, Victor, N.Y.

[73] Assignee: Xerox Corporation, Stamford, Conn.

[21] Appl. No.: 411,173

[22] Filed: Mar. 27, 1995

[51] Int. Cl.[6] ..... G13G 15/20

[52] U.S. Cl. ..... 355/285; 219/216

[58] Field of Search ..... 355/282, 285, 355/290, 286, 289; 219/216; 430/97, 124; 432/59, 60; 118/58, 59, 60

[56] References Cited

U.S. PATENT DOCUMENTS

| | | | |
|---|---|---|---|
| 3,566,076 | 2/1971 | Fantuzzo et al. | 219/216 |
| 3,679,302 | 7/1972 | Ludwig | 355/17 |
| 4,223,203 | 9/1980 | Elter | 219/216 |
| 4,627,813 | 12/1986 | Sasaki | 432/60 |
| 4,639,405 | 1/1987 | Franke | 430/124 |
| 4,791,447 | 12/1988 | Jacobs | 355/3 FU |
| 4,875,611 | 10/1989 | Poehlein et al. | 226/186 |
| 5,436,711 | 7/1995 | Hauser | 355/290 |

FOREIGN PATENT DOCUMENTS

| | | | |
|---|---|---|---|
| 3-211576 | 1/1990 | Japan | 355/282 |

*Primary Examiner*—Joan H. Pendegrass

[57] ABSTRACT

An image treatment method and apparatus for fusing color toner images to a substrate such that they exhibit uniform gloss and satisfactory color saturation properties. A substrate carrying color toner images is passed through an oven heater for fixing the color toner images to the substrate. The color images are then passed through the nip of a pair of glossing rolls. The glossing rolls are operated at approximately the fusing temperature provided in the oven fuser.

18 Claims, 2 Drawing Sheets

HYBRID COLOR FUSER

BACKGROUND OF THE INVENTION

This invention relates generally to electrophotographic printing and more particularly relates to an image treatment method and apparatus for fusing color toner images to a substrate such that they exhibit uniform gloss and satisfactory color saturation properties.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an abhesive material, such as a silicone rubber or other low surface energy elastomer, for example, tetrafluoroethylene resin sold by E. I. DuPont De Nemours under the trademark Teflon. To further enhance release, a release agent material such as silicone oil is applied to elastomer coating.

Conventional roll fusers are operated such that roll surface temperatures are in the order of 390°–425° F. Operation at these temperatures, results in shortened roll life and less reliability due to random failures such as rubber peeling off the rollers.

Following is a discussion of prior art, incorporated herein by reference, which may bear on the patentability of the present invention. In addition to possibly having some relevance to the patentability, these references, together with the detailed description to follow, may provide a better understanding and appreciation of the present invention.

"Two stage" fusing is known. For example, U.S. Pat. No. 3,861,863 discloses a black and white image fuser comprising a first stage backside heater and a second stage soft roll fuser.

U.S. Pat. No. 3,679,302 discloses first and second stage radiant fusers.

U.S. Pat. No. 3,566,076 discloses the combination of radiant and pressure fusing.

U.S. Pat. No. 4,875,611 granted Oct. 24, 1989 discloses a copy media feed system including two pair of feed rolls which are horizontally aligned to form nip areas to engage the media. Each feed roll pair comprises one drive roll and one idler roll. For one pair, the drive roll is an elastomer-covered, high friction roll and the idler roll is a hard, roll. For the second pair the drive roll is a hard, high friction roll and the idler roll is an elastomer-covered roll. This arrangement provides accurate control of the media velocity.

U.S. Pat. No. 4,791,447 granted Dec. 13, 1988 discloses a heat and pressure fusing apparatus for fixing color toner images to various types of copy substrates. The apparatus includes three roll members which cooperate to form a pair of nips. All substrates pass through a first nip and a deflector plate directs certain types of substrates through the second nip. Passage of the substrates through the first nip causes the images carried thereon to contact a conformable elastomeric surface while passage through the second nip causes them to contact a relatively rigid surface. Thus, glossy and matte color copies on substrates such as plain paper and high chroma transparencies are suitably produced in a color reproduction apparatus incorporating this fuser. Matte color copies are produced by passing the substrate through only the first nip while glossy color copies and high chroma transparencies are produced by passing the substrates through both nips.

U.S. Pat. No. 4,639,405 granted Jan. 27, 1987 discloses a method and apparatus for fixing toner images in which a copy sheet bearing unfixed toner is first passed through a pair of heated fuser rollers and is subsequently passed through surfacing rollers to provide a gloss to the toner image. In order to prevent curling of the copy sheet and blistering of the glossed image, the copy sheet is passed through a conditioner means, located between the fuser rollers and the surfacing rollers, for removing a substantial portion of the moisture from the copy sheet.

U.S. Pat. No. 4,627,813 granted Dec. 9, 1986 discloses a thermal fixing apparatus for use with a copying machine or electronic printer in which an operating temperature of the apparatus after energization is quickly reached. A pair of fixing rolls is provided, at least one of which in heated. The outer surface of the other is covered with an elastically deformable outer layer. The two rolls are pressed into abutment with one another to form a nip therebetween of the predetermined width. A plate-shaped heater element is disposed prior to the nip adjacent the path of conveyance of toner-image-bearing paper sheets to be fixed. The plane of the heater element is preferably parallel to the plane of the paper. The surface temperature of the heater element has a temperature higher at central portions than at widthwise ends thereof to provide uniform fixing conditions.

U.S. Pat. No. 4,223,203 granted Sep. 16, 1980 discloses a heat and pressure fusing apparatus for fixing toner images to copy substrates comprising a first fusing system consisting of a pair of nip forming rolls, one of which is provided with a conformable outer surface and a second fusing system consisting of a pair of nip forming rolls, one of which has a rigid outer surface. Copy substrates are passed sequentially through the nips of the first and second fusing systems, in that order such that the toner images sequentially contact the conformable outer surface and then the rigid outer surface.

BRIEF SUMMARY OF THE INVENTION

Improved color image fusing and glossing is accomplished by the provision of a heated oven through which substrates carrying color toner images are conveyed for fusing the color toner images. While the color images are adequately fused in the oven they do not exhibit uniform gloss and color saturation properties resulting in color images wherein the appearance is not as robust, from a quality standpoint, as desired. The substrate with the fused color images carried thereby is then moved through a pair of nip forming glossing rolls, at least one of which is heated to a surface temperature approximately equal to the fusing temperature to which the color images were subjected as they were passed through the heated oven. Elevating the temperatures of the color toner images and substrate to less than the required fusing temperature of the toner would result in cold toner offset to the glossing roll or to both rolls in the case of duplex images.

The aforementioned surface temperature is approximately 300° F. At this temperature, the fuser rollers are not subjected to the normal operating temperature of of a conventional heated roll fuser which is abut 390° F. The properties, for example, soft, deformable outer surface, of the roll surface contacting the color toner are such that uniform gloss is imparted to the images and substrate self-stripping is enabled.

Operating the heated rolls at the substantially lower temperature results in longer life and reliability. Thus, random failures such as rubber peeling off the roll are minimized.

The requirement of the lower glossing temperature enables the use of glossing rollers which are significantly smaller in diameter than conventional fuser rolls resulting in cost savings.

Variable gloss selection on demand is selectively effected by varying the operating temperature of the oven fuser thereby varying the amount of heat imparted to the substrate and color toner images carried thereby.

DETAILED DESCRIPTION OF THE PREFERRED EMBODIMENT(S) OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 2:
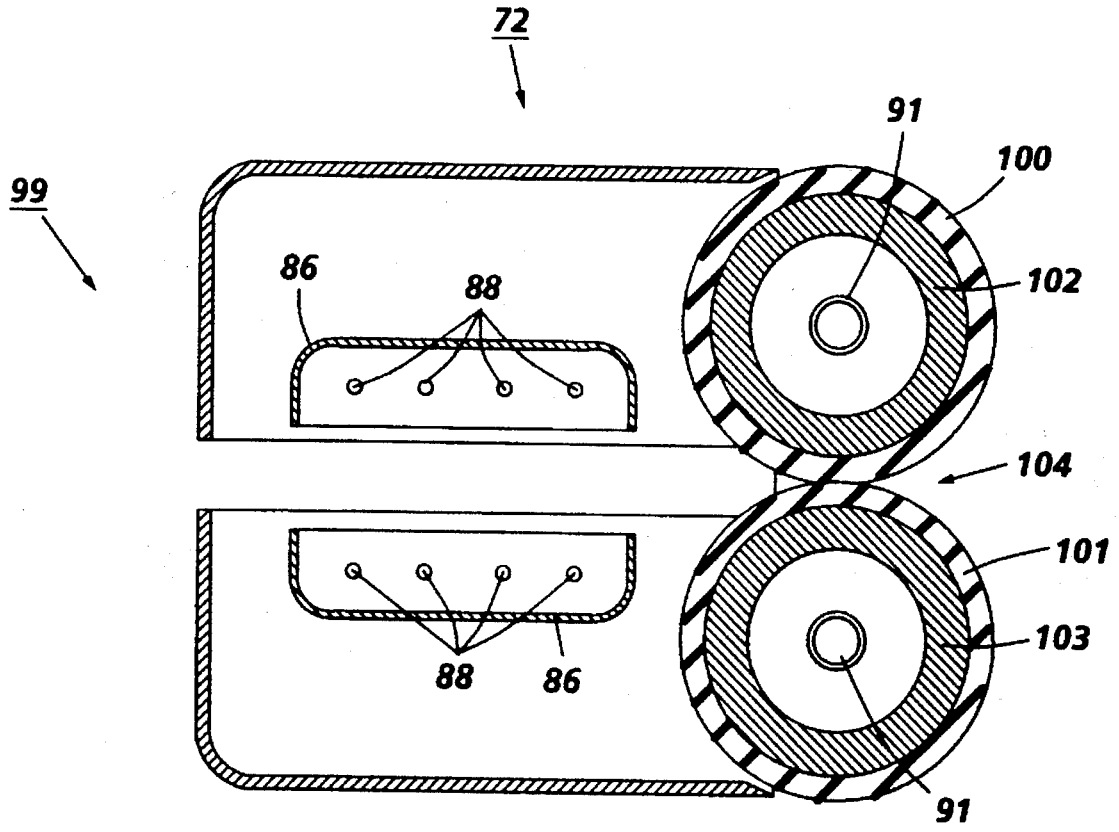
FIG. 2 is a schematic illustration of a imaging apparatus incorporating the invention.

For a general understanding of the features of the present invention, reference is made to the drawings. FIG. 2 schematically depicts the various components of an illustrative electrophotographic printing machine incorporating the present invention therein. It will become evident from the following discussion that the apparatus of the present invention is equally well suited for use in a wide variety of printing machines, and is not necessarily limited in its application to the particular electrophotographic printing machine shown herein.

Inasmuch as the art of electrophotographic printing is well known, the various processing stations employed in the FIG. 2 printing machine will be shown hereinafter schematically and their operation described briefly with reference thereto.

As shown in FIG. 2, the electrophotographic printing machine employs a photoconductive belt 10. Preferably, the photoconductive belt 10 is fabricated from a photoconductive material coated on a grounding layer, which, in turn, is coated on an anti-curl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed.

The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

Figure 1:
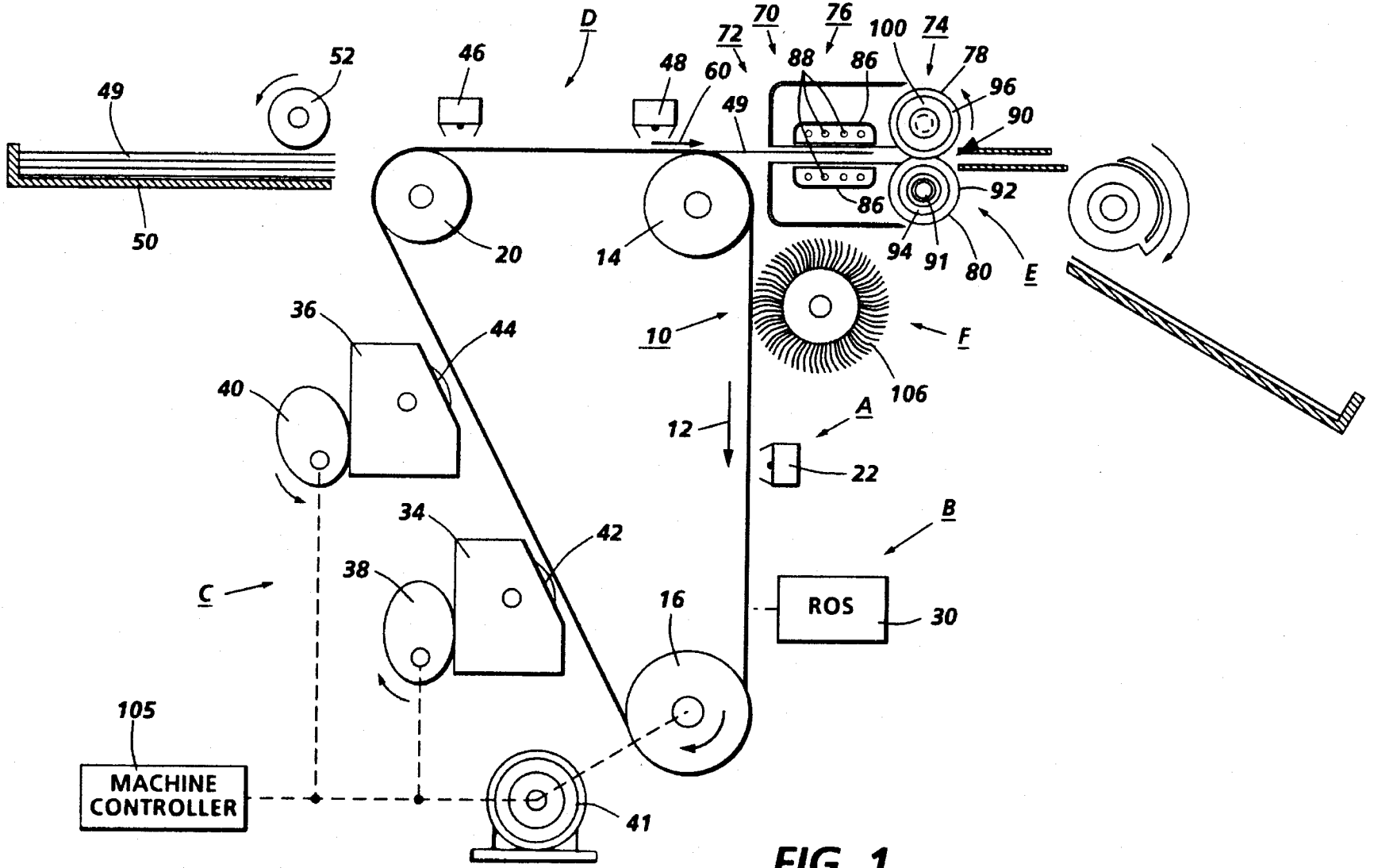
FIG. 1 is a schematic illustration of a color toner treatment apparatus according to the invention.

With continued reference to FIG. 1, initially a portion of the belt 10 passes through charging station A. At charging station A, a corona device 22 charges a portion of the photoreceptor belt 10 to a relatively high, substantially uniform potential, either positive or negative.

At exposure station B, a raster output scanner (ROS) 30 is provided to imagewise discharge the photoreceptor in accordance with stored electronic information. The ROS is preferably a three level device capable of forming a tri-level image comprising two image levels and a background level intermediate the two image levels.

Thereafter, the belt 10 advances the electrostatic latent image to development station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 41. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, either one of the two developer housings may be inactivated by camming it away from the belt 10.

The photoreceptor belt 10 then advances the developed latent image to transfer station D. At transfer station D, a sheet of support material such as paper copy sheets is advanced into contact with the developed latent images on the belt 10. A corona generating device 46 deposits electrostatic charges of a suitable polarity onto the backside of a copy sheet so that the toner powder images are attracted from the photoreceptor belt 10 to the sheet. After transfer, a corona generator 48 sprays electrostatic charges of a suitable polarity on the copy for assisting stripping of the copy sheet from the belt adjacent stripping roller 14.

Sheets or substrates of image support material 49 are advanced to transfer station D from a supply tray 50. Sheets are fed from tray 50 with sheet feeder 52, and advanced into contact with the photoreceptor belt 10 in the transfer station D.

After transfer, the sheet continues to move in the direction of arrow 60 to a color image treatment station E. The station E includes a color image treatment device, indicated generally by the reference numeral 70, which permanently affixes the transferred color toner images to the sheets while imparting gloss to the images for producing enhanced color images. Preferably, device 70 includes a fusing section 72 and a glossing section 74. The fusing section 72 comprises a heated oven fuser 76 while the glossing section comprises a pair of glossing rolls 78 and 80. The fusing and glossing sections may form an integral structure or may be independent of each other.

Copy substrates 49 move from the photoreceptor belt 10 to the heated oven fuser 76 The oven comprises an outer housing 82 and an inner chamber delineated by reflector members 86. A plurality of heater elements 88 are operatively supported in the space between the members 86. The oven is operated at a temperature adequate to completely fuse the color toner images. Conventional color toners are acceptably fused in the oven at about 300° F. However, the images do not exhibit uniform gloss properties.

From the oven, the substrate continues into and through a nip 90 formed between the glossing rolls 78 and 80. By way of example, the glossing rolls 78 and 80 are disclosed as simplex image glossing rolls, in that, a deformable layer 92 carried by a rigid core 94 of roll 80 is deformed by the roll 78. The unheated roll 78 has a thinner layer 96 of elastomeric material carried by a rigid core member 98. The roll 80 is provided with a heating structure 91 disposed internally for elevating the surface temperature of the roll 80. The rolls are also heated by virtue of their contact with the heated substrate which is heated while passing through the oven fuser 76. Together, the heat from the substrate and a relative small amount of heat from the heating structure 92 effect elevation of the surface temperature of roll 80 to approximately the temperature at which the oven fuser is operated, that is, about 300° F. An operating temperature of the glossing rolls above the temperature of the oven fuser is not required because the color toner images are fused before they reach the glossing rolls. The sole purpose of the glossing rolls is to produce a uniform gloss in the color images. Thus, the glossing rolls will exhibit longer life and reliability compared to rolls normally employed in the image fixing process which must be operated at a substantially higher temperature than the 300° F. at which the glossing rolls are operated.

Disclosed in FIG. 2 is a modified embodiment 99 of the image treatment station 70 of FIG. 1. The embodiment 99 differs from the station 70, in that, a pair of rolls 100 and 101 both have rigid cores with outer deformable layers 102 and 103 fabricated, for example, from silicone rubber. The rolls 102 and 103 form a symmetrical nip 104 therebetween for fusing duplex color toner images. In this embodiment, the rolls are provided with internal heat lamps 91.

A Release Agent Management (RAM) system, not shown, may be employed for applying a release agent material to one or both of the glossing rolls.

Residual particles, remaining on the photoreceptor belt 10 after each copy is made, may be removed at cleaning station F. The cleaning apparatus comprises a brush 106. Removed residual particles may be stored for disposal in a conventional manner.

A machine controller 105, preferably a known programmable controller or combination of controllers, is provided for controlling the machine steps and functions described above. The controller 105 is responsive to a variety of conventional sensing devices, not shown, to enhance control of the machine, and also provides connection of diagnostic operations to a user interface (not shown) where required. The motor 41 for driving the belt drive roller 16 is also controlled by the controller 105.

As thus described, a reproduction machine incorporating the present invention may be any of several well known devices. Variations may be expected in specific electrophotographic processing, paper handling and control arrangements as well as types of substrates employed without affecting the present invention. However, it is believed that the foregoing description is sufficient for purposes of the present application to illustrate the general operation of an electrophotographic printing machine which exemplifies one type of apparatus employing the present invention therein.

What is claimed is:

1. A method of fusing color toner images to a substrate including the steps of:

using a first color toner image treatment device comprising a heated oven, subjecting a substrate having color toner images thereon to thermal energy sufficient to effect fusing of said color toner images to said substrate;

using a second color toner treatment device including a deformable surface, imparting uniform gloss to said colored toner images subsequent to subjecting them to said thermal energy by contacting them with said deformable surface.

2. The method according to claim 1 wherein said step of using a heated oven comprises operating said heated oven at approximately 300° F.

3. The method according to claim 2 wherein said step of using a second color toner treatment device including a deformable surface comprises using a nip forming roll pair.

4. The method according to claim 3 wherein said step of imparting uniform gloss to said color toner images comprises operating said deformable surface at approximately the operating temperature of said heated oven.

5. The method according to claim 4 wherein said step of using a pair of nip forming rolls comprises using a roll having a rigid core and a deformable outer layer, the latter of which is deformed by another roll of said roll pair.

6. The method according to claim 5 wherein said step of using a roll having a rigid core and a deformable outer layer comprises using silicone rubber as said outer layer pair of nip forming rollers comprises using a pair of rolls having rigid cores, each having an outer layer of deformable material.

7. The method according to claim 2 wherein said step of using a a second color toner treatment device comprises using a pair nip forming rolls each having a rigid core with rubber outer layers.

8. The method according to claim 7 wherein said step of of using a pair of rolls nip forming rolls each having a rigid core with a rubber outer layer comprise using using rolls forming a symmetrical nip.

9. The method according to claim 8 wherein the thickness of said outer layers on said pair of rolls is of equal thickness.

10. Apparatus for fusing color toner images to a substrate, said apparatus comprising:

a first color toner image treatment device comprising a heated oven for subjecting a substrate having color toner images thereon to thermal energy sufficient to effect fusing of said color toner images to said substrate;

a second color toner treatment device including a deformable surface for imparting uniform gloss to said colored toner images subsequent to subjecting them to said thermal energy by contacting them with said deformable surface.

11. Apparatus according to claim 10 including means for operating said heated oven at approximately 300° F.

12. Apparatus according to claim 11 wherein said second color toner treatment device includes a deformable surface comprises using a nip forming roll pair.

13. Apparatus according to claim 12 wherein said means for imparting uniform gloss to said color toner images comprises operating said deformable surface at approximately the operating temperature of said heated oven.

14. Apparatus according to claim 13 wherein said pair of nip forming rolls comprises a roll having a rigid core and a deformable outer layer, the latter of which is deformed by another roll of said roll pair.

15. Apparatus according to claim 14 wherein said deformable outer layer comprises silicone rubber.

16. Apparatus according to claim 11 wherein said second color toner treatment device comprises a pair nip forming rolls each having a rigid core with rubber outer layers.

17. Apparatus according to claim 16 wherein said nip is symmetrical.

18. Apparatus according to claim 17 wherein the thickness of said outer layers on said pair of rolls is of equal thickness.

* * * * *